US011081824B2

(12) United States Patent
Schmidt et al.

(10) Patent No.: US 11,081,824 B2
(45) Date of Patent: Aug. 3, 2021

(54) CONTACT ELEMENT AND CONTACT SYSTEM

(71) Applicant: TE Connectivity Germany GmbH, Bensheim (DE)

(72) Inventors: Helge Schmidt, Speyer (DE); Waldemar Stabroth, Mommenheim (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 16/203,764

(22) Filed: Nov. 29, 2018

(65) Prior Publication Data

US 2019/0097343 A1 Mar. 28, 2019

Related U.S. Application Data

(63) Continuation of application No. PCT/EP2017/063400, filed on Jun. 1, 2017.

(30) Foreign Application Priority Data

Jun. 2, 2016 (DE) ..... 10 2016 110 231

(51) Int. Cl.
*H01R 13/11* (2006.01)

(52) U.S. Cl.
CPC ..... *H01R 13/113* (2013.01); *H01R 13/114* (2013.01)

(58) Field of Classification Search
CPC ..... H01R 13/114
USPC ..... 439/843, 851, 852
See application file for complete search history.

(56) References Cited

U.S. PATENT DOCUMENTS 4,900,271 A 2/1990 Colleran et al.
5,529,517 A * 6/1996 Hopf ..... H01R 13/11 439/374
5,741,162 A * 4/1998 Kourimsky ..... H01R 13/432 439/746

(Continued)

FOREIGN PATENT DOCUMENTS

CN 1206509 A 1/1999
CN 1328361 A 12/2001

(Continued)

OTHER PUBLICATIONS

German Office Action, dated Apr. 27, 2017, 8 pages.

(Continued)

*Primary Examiner* — Abdullah A Riyami
*Assistant Examiner* — Marcus E Harcum
(74) *Attorney, Agent, or Firm* — Barley Snyder

(57) ABSTRACT

A contact element comprises a contact box extending in a longitudinal direction of the contact element and delimiting a receptacle. The contact box includes a first box section, a second box section, a third box section arranged opposite the first box section, and a fourth box section arranged opposite the second box section. The second box section and the fourth box section each connect the first box section to the third box section. The first box section and the third box section are each configured in an elastic manner and the second box section and the fourth box section are each configured in a rigid manner. The second box section and the fourth box section are each inclined with respect to the first box section.

21 Claims, 8 Drawing Sheets

(56) References Cited

U.S. PATENT DOCUMENTS

| | | | | |
|---|---|---|---|---|
| 5,879,205 | A * | 3/1999 | Egenolf | H01R 13/11 29/882 |
| 5,890,936 | A | 4/1999 | McDonald et al. | |
| 5,997,363 | A | 12/1999 | Joly | |
| 7,988,505 | B2 * | 8/2011 | Hotea | H01R 13/187 439/852 |
| 9,011,186 | B2 * | 4/2015 | Wirth | H01R 13/112 439/843 |
| 2001/0051472 | A1 * | 12/2001 | Sato | H01R 13/11 439/852 |
| 2006/0292937 | A1 * | 12/2006 | Morello | H01R 13/113 439/856 |
| 2007/0161300 | A1 * | 7/2007 | Ishigami | H01R 4/184 439/851 |
| 2007/0202744 | A1 | 8/2007 | Dummel et al. | |
| 2012/0142233 | A1 * | 6/2012 | Blasko | H01R 13/113 439/852 |

FOREIGN PATENT DOCUMENTS

| | | | |
|---|---|---|---|
| CN | 1871749 | A | 11/2006 |
| DE | 69719706 | T2 | 11/2003 |
| DE | 20221168 | U1 | 6/2005 |
| EP | 0384577 | A2 | 8/1990 |
| JP | 2000-516030 | A | 11/2000 |
| JP | 2001-210418 | A | 8/2001 |
| JP | 2002-63961 | A | 2/2002 |
| JP | 2006-172732 | A | 6/2006 |
| JP | 2014-35875 | A | 2/2014 |

OTHER PUBLICATIONS

Abstract of DE 20221168, dated Jun. 9, 2005, 1 page.
PCT International Search Report and Written Opinion of the International Searching Authority, dated Aug. 3, 2017, 12 pages.
Chinese First Office Action with English translation, Chinese Patent Application No. 201780033404.2, dated Jul. 23, 2019, 19 pages.
Japanese Notice of Reasons for Refusal with English translation, Japanese Patent Application No. 2018-562593, dated Dec. 3, 2019, 14 pages.
Abstract of JP 2006-172732 A, dated Jun. 29, 2006, 1 page.
Abstract of JP 2001-210418 A, dated Aug. 3, 2001, 1 page.
Abstract of JP 2014-35875 A, dated Feb. 24, 2014, 2 pages.
European Patent Communication, dated Feb. 3, 2020, 6 pages.
Second Chinese Office Action and English translation, dated Apr. 28, 2020, 20 pages.

* cited by examiner

CONTACT ELEMENT AND CONTACT SYSTEM

CROSS-REFERENCE TO RELATED APPLICATIONS

This application is a continuation of PCT International Application No. PCT/EP2017/063400, filed on Jun. 1, 2017, which claims priority under 35 U.S.C. § 119 to German Patent Application No. 102016110231.8, filed on Jun. 2, 2016.

FIELD OF THE INVENTION

The present invention relates to a contact element and, more particularly, to a contact element having an elastic contact box.

BACKGROUND

A contact element has a contact box and a connecting section. The contact box is connected to the connecting section and an internal spring is disposed in the contact box. The internal spring forms an electrical connection with an engagement section of a mating contact element inserted into the contact box. An electrical wire can be fastened to the connecting section.

SUMMARY

A contact element comprises a contact box extending in a longitudinal direction of the contact element and delimiting a receptacle. The contact box includes a first box section, a second box section, a third box section arranged opposite the first box section, and a fourth box section arranged opposite the second box section. The second box section and the fourth box section each connect the first box section to the third box section. The first box section and the third box section are each configured in an elastic manner and the second box section and the fourth box section are each configured in a rigid manner. The second box section and the fourth box section are each inclined with respect to the first box section.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
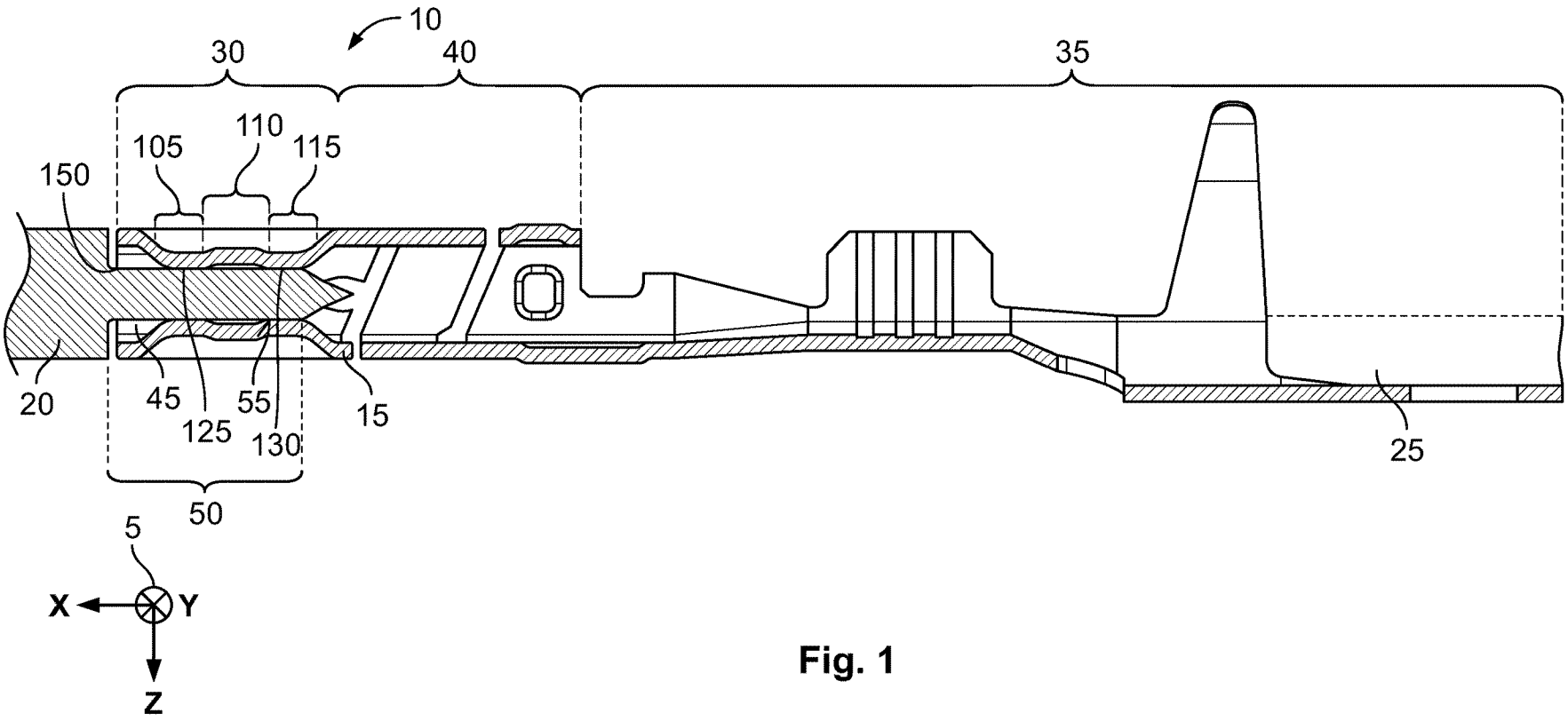
FIG. 1 is a sectional side view of a contact system according to an embodiment.

Exemplary embodiments of the present invention will be described hereinafter in detail with reference to the attached drawings, wherein like reference numerals refer to like elements. The present invention may, however, be embodied in many different forms and should not be construed as being limited to the embodiments set forth herein. Rather, these embodiments are provided so that the present disclosure will be thorough and complete and will fully convey the concept of the disclosure to those skilled in the art.

Reference is made to a coordinate system 5 in the following description. The coordinate system 5 includes an x-axis, a y-axis, and a z-axis. The coordinate system 5 is configured, by way of example, as a right-handed system. The x-axis can also be referred to as the longitudinal direction, the y-axis as the transverse direction to the longitudinal direction, and the z-direction as the vertical direction. The y-axis and the z-axis are each transverse or orthogonal to the longitudinal direction.

A contact system 10 is shown in FIG. 1. The contact system 10 includes a contact element 15 according to an embodiment shown in FIGS. 1-4 and a mating contact element 20 matable with the contact element 20. The contact element 15 can be electrically connected to an electrical conductor 25.

The contact element 15, as shown in FIGS. 1-4, includes a contact box 30, a connecting section 35, and a connection section 40. The connection section 40 is disposed between the contact box 30 and the connecting section 35 in the longitudinal direction. The electrical conductor 25 is connected in an electrically conducting manner to the connecting section 35. In an embodiment, the connecting section 35 is connected to the electrical conductor 25 by a crimp connection. The electrical conductor 25 can also be connected in a different manner to the connecting section 35, such as soldering.

Figure 2:
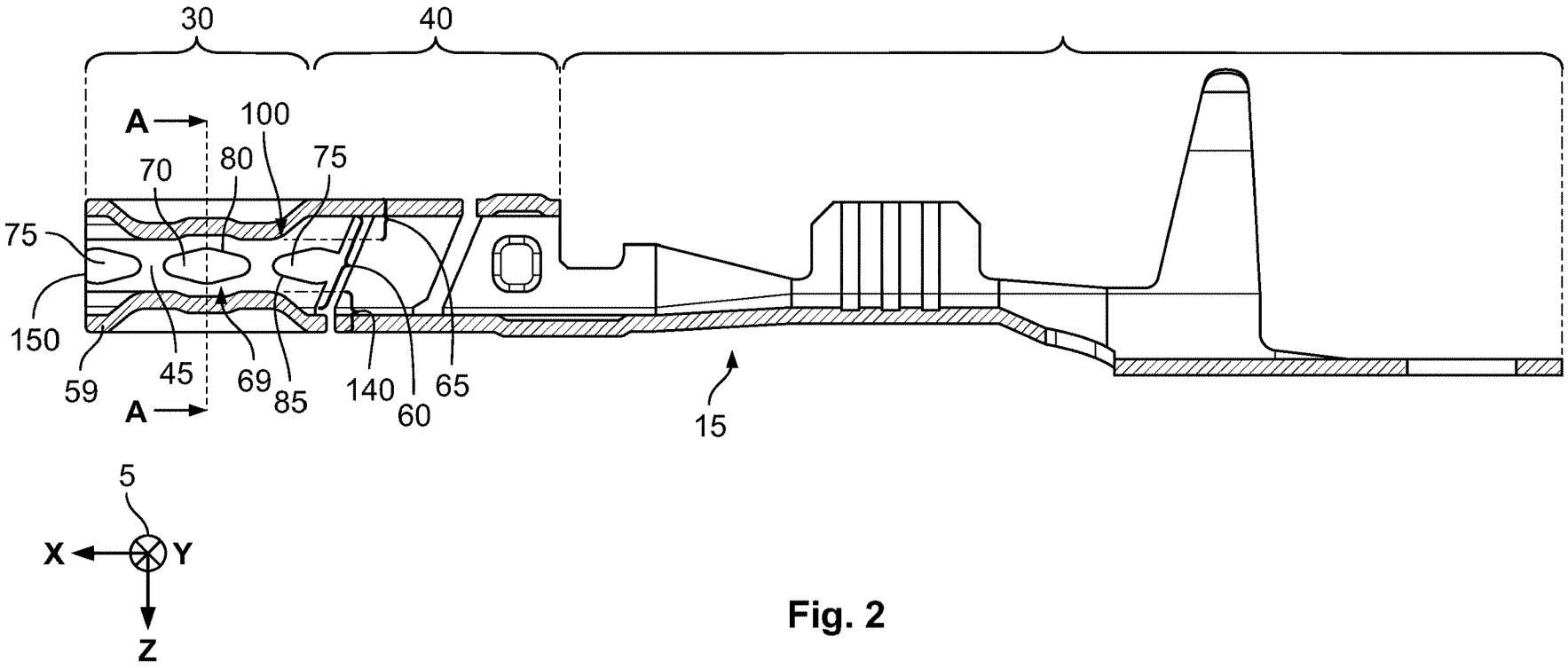
FIG. 2 is a sectional side view of a contact element according to an embodiment.
Figure 4:
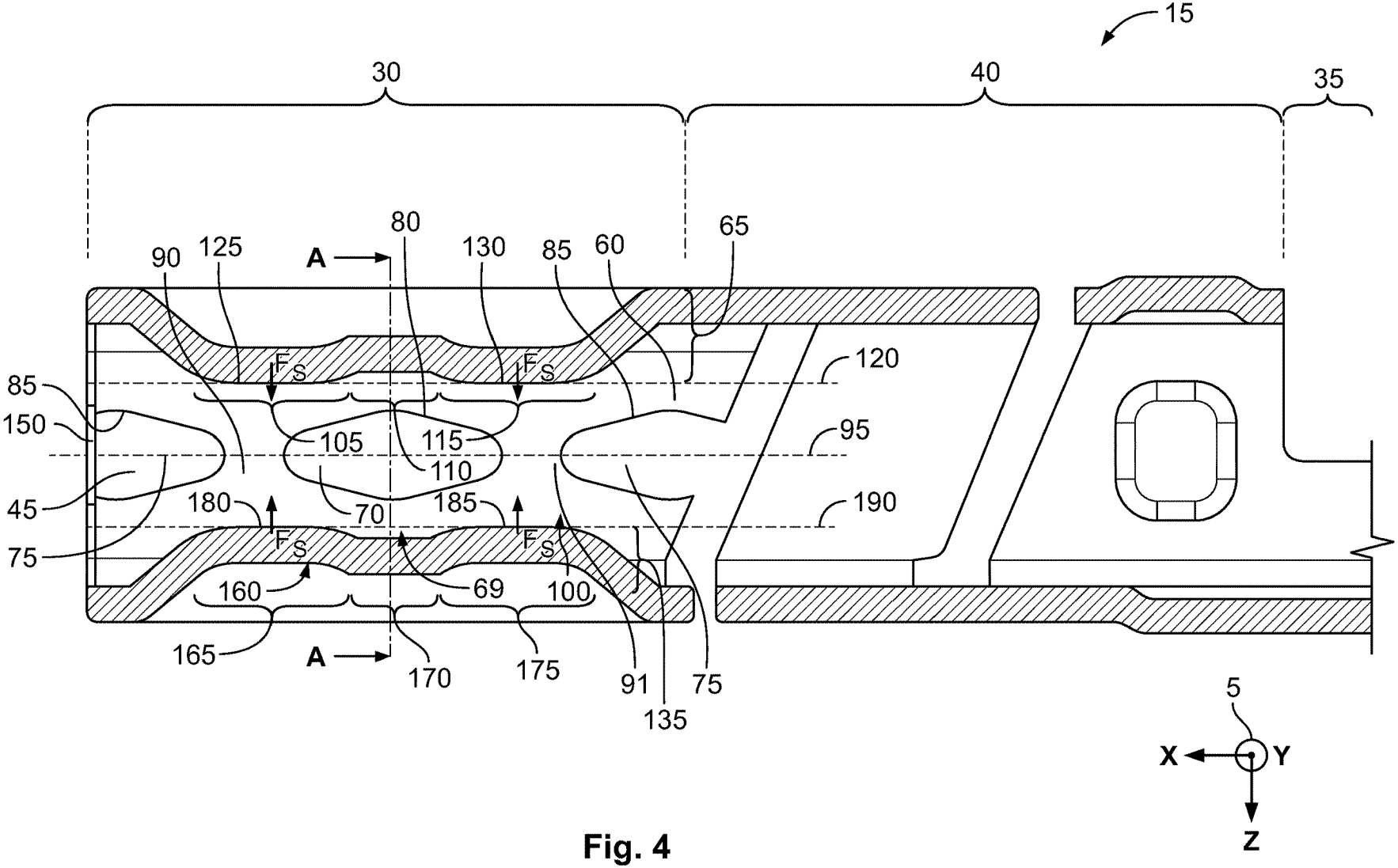
FIG. 4 is a detailed sectional side view of the contact element of FIG. 2.

The connection section 40, as shown in FIGS. 1, 2, and 4, connects the connecting section 35 to the contact box 30. The connection section 40 is flexibly configured in the transverse direction and/or vertical direction (y-direction and/or z-direction) in the shown embodiment and reduces a transfer of mechanical deformations and/or vibrations between the connecting section 35 and the contact box 30. In another embodiment, the connection section 40 can be dispensed with; in such an embodiment, the connecting section 35 is connected directly to the contact box 30. The connection section 40 can also be configured in a different manner than that shown in FIG. 1.

As shown in FIG. 1, the contact box 30 circumferentially delimits a receptacle 45 of the contact element 15. The receptacle 45 has a receptacle opening 150 on a side facing away from the connection section 40. In an assembled condition of the contact system 10, an engagement section 50 of the mating contact element 20 is inserted into the receptacle 45 at the receptacle opening 150. On the inner side, the contact box 30 abuts a circumferential contact surface 55 of the engagement section 50 and electrically connects the mating contact element 20 to the contact element 15.

The contact box 30 extends in the longitudinal direction (x-direction) of the contact element 15. The contact box 30, as shown in FIG. 2, includes a wall 59. The wall 59 has a first box section 60 and a second box section 65 connected to the first box section 60. The first box section 60 extends in an xz-plane and the second box section 65 is aligned perpendicularly to the first box section 60 and extends in an xy-plane. The first box section 60 is configured in an elastic manner, and in an embodiment is configured as a tension spring. As shown in FIG. 2, the first box section 60 includes a first grid structure 69 with a plurality of recesses 70, 75. In the shown embodiment, the first grid structure 69 has a first recess 70 and at least a second recess 75. In other embodiments, the number of recesses 70, 75 can be more than two, and in the case of a particularly compact configuration of the contact box 30 in the longitudinal direction, the first grid structure 69 can also include only one of the recesses 70, 75.

In the embodiment shown FIGS. 2 and 4, the first grid structure 69 has a pair of second recesses 75. One second recess 75 is arranged on a side of the first grid structure 69 facing the receptacle opening 150 and another second recess 75 is arranged on a side of the first grid structure 69 facing the connection section 40. The first recess 70 is arranged in the longitudinal direction between the second recesses 75.

The second box section 65 includes a first embossed structure 100 shown in FIG. 2 and is configured in a substantially rigid and bend-resistant manner. Additionally or alternatively to the first embossed structure 100, the second box section 65 can include a bracing.

Figure 3:
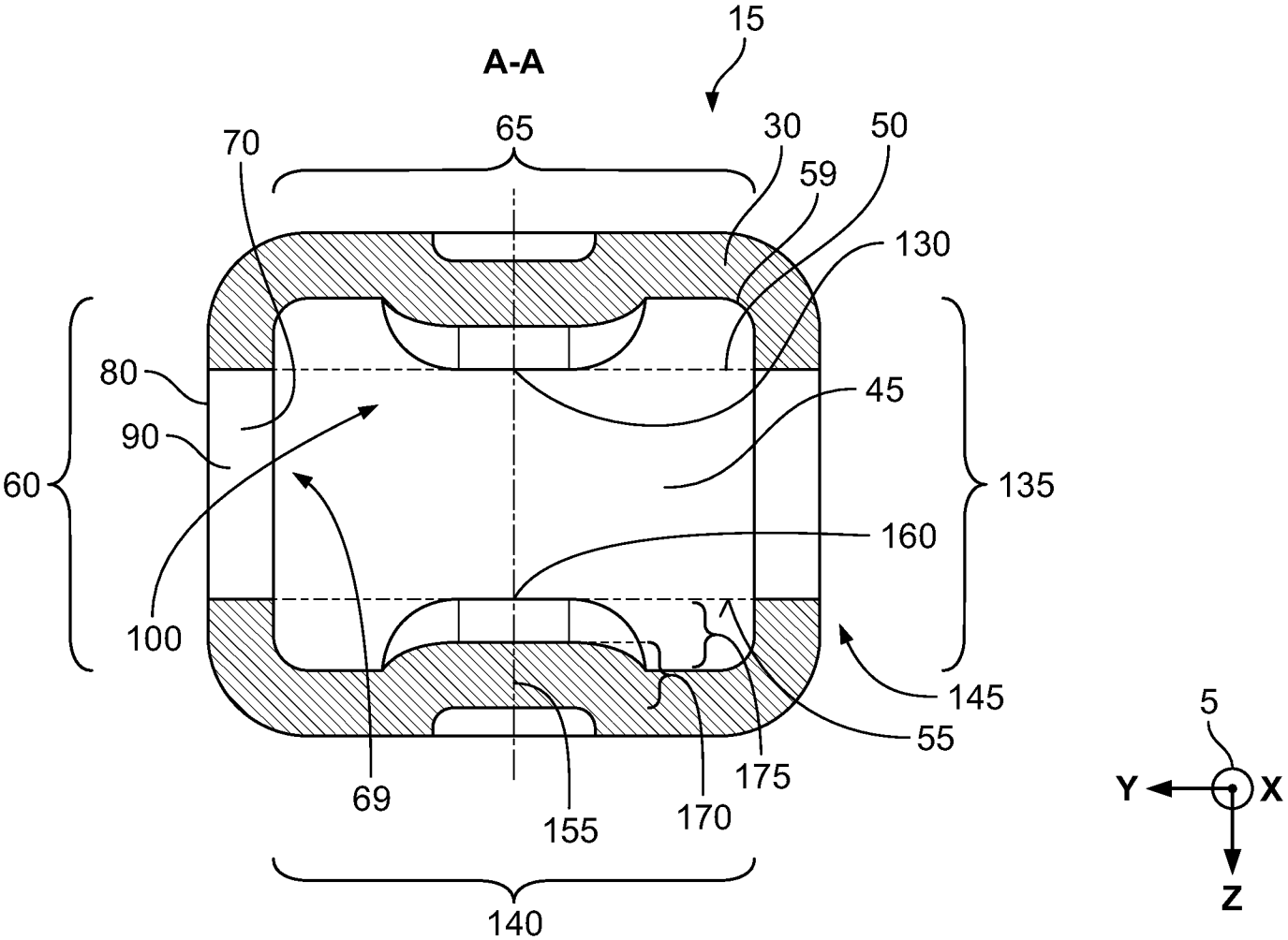
FIG. 3 is a sectional front view of the contact element, taken along line A-A of FIG. 2.

As shown in FIG. 3, the wall 59 of the contact box 30 includes a third box section 135 and a fourth box section 140.

The third box section 135, as shown in FIG. 3, is arranged opposite the first box section 60 in the transverse direction and extends in an xz-plane. The second box section 65 is arranged between the first box section 60 and the third box section 135 and connects the third box section 135 to the first box section 60 on an upper side of each. In the shown embodiment, the first box section 60 and the third box section 135 are arranged parallel to each other. In another embodiment, the first box section 60 and the third box section 135 can also be configured in an inclined manner with respect to each other. The first box section 60 and the third box section 135 can be arranged with respect to each other in such a manner that the receptacle 45 tapers from the receptacle opening 150 towards the connecting section 35. In another embodiment, the second box section 65 and the fourth box section 140 are each inclined with respect to the first box section 60.

The third box section 135 is configured identically to the first box section 60 in the shown embodiment. The third box section 135 is configured in a spring-elastic manner, and in an embodiment is configured as a tension spring. The third box section 135 includes a second grid structure 145. The second grid structure 145 is configured identically to the first grid structure 69 of the first box section 60. The second grid structure 145 and the first grid structure 69 are configured mirror-symmetrically with respect to a plane of symmetry 155 which is arranged between the first box section 60 and the third box section 135 and which extends in an xz-plane. As a result of the symmetrical configuration of the first grid structure 69 and the second grid structure 145, a uniform loading of the respective grid structure 69, 145 is ensured.

The fourth box section 140 is arranged opposite the second box section 65 in the z-direction, as shown in FIG. 3. The second box section 65 is arranged above the receptacle 45 and the fourth box section 140 is arranged below the receptacle 45. The fourth box section 140 is arranged in the transverse direction between the first box section 60 and the third box section 135 and connects the first box section 60 to the third box section 135. In an embodiment, the fourth box section 140 has a second embossed structure 160. Additionally or alternatively to the second embossed structure 160, the fourth box section 140 can comprise a bracing. The fourth box section 140 is configured in a substantially rigid and bend-resistant manner.

As shown in FIG. 4, the first recess 70 has a first recess contour 80, and each of the second recesses 75 has a second recess contour 85. In the shown embodiment, the first recess contour 80 and the second recess contour 85 are configured identically in sections. In other embodiments, the first recess contour 80 can be configured differently to the second recess contour 85. In the shown embodiment, each recess contour 80, 85 has a diamond shape. Additionally or alternatively, each recess contour 80, 85 can at least in sections be rectangular and/or square and/or polygonal and/or round and/or elliptical and/or circular and/or slotted.

In the embodiment shown in FIG. 4, the recess 70, 75 is configured so as to extend completely through the material of the first box section 60. The recess 70, 75 can also be configured as a material tapering in the first box section 60. The first recess 70 and the second recesses 75 are arranged in a common plane 95. The plane 95 is in this case configured as an xy-plane.

The first grid structure 69, as shown in FIG. 4, includes a first crosspiece 90 and at least a second crosspiece 91. The first crosspiece 90 is arranged between the first recess 70 and one of the second recesses 75. The second crosspiece 91 is arranged offset in the longitudinal direction between the first recess 70 and another second recess 75. In the embodiment, the crosspiece 90, 91 has, by way of example, a planar configuration. The crosspiece 90, 91 can also be configured in a different manner. In the shown embodiment, the first crosspiece 90 and the second crosspiece 91 have an hourglass-like configuration as a result of the geometric configuration of the recess 70, 75; the crosspiece 90, 91 is narrowest in the longitudinal direction at the level of the plane 95 in which the recess 70, 75 have a greatest longitudinal extent.

The first embossed structure 100, as shown in FIG. 4, includes a first structure section 105, a second structure section 110, and a third structure section 115. The first structure section 105 and the third structure section 115 are arranged in a common first contact plane 120. The second structure section 110 connects the first structure section 105 to the third structure section 115 and is arranged in the longitudinal direction between the first structure section 105 and the third structure section 115. The second structure section 110 is arranged offset outwardly from the receptacle 45 with respect to the first structure section 105 and the third structure section 115.

If the engagement section 50 of the mating contact element 20 is inserted into the receptacle 45, the first structure section 105 is a first contact 125 contacting the contact surface 55 and the third structure section 115 is a second contact 130 contacting the contact surface 55. The second contact 130 is arranged offset from the first contact 125 in the longitudinal direction. The first contact 125 and the second contact 130 are arranged in the common first contact plane 120. The first contact plane 120 is parallel to the plane 95. In the shown embodiment, the first crosspiece 90 is aligned with the first contact 125 and the second crosspiece 91 is arranged in the longitudinal direction aligned with the second contact 130.

The second embossed structure 160, as shown in FIG. 4, includes a fourth structure section 165, a fifth structure section 170, and a sixth structure section 175. In the longitudinal direction, the fifth structure section 170 is arranged between the fourth structure section 165 and the sixth structure section 175 and connects the fourth structure section 165 to the sixth structure section 175. The fourth structure section 165 is arranged on a side distal from the connecting section 35, and the sixth structure section 175 is arranged on a side of the fifth structure section 170 proximal to the connecting section 35. The fifth structure section 170 is recessed with respect to the receptacle 45 in the z-direction and is arranged lower than the fourth structure section 165 and the sixth structure section 175.

When the engagement section 50 of the mating contact element 20 is inserted, the fourth structure section 165 is a third contact 180 contacting the contact surface 55 on a side of the fourth structure section 165 facing the receptacle 45. When the engagement section 50 is inserted, the fifth structure section 170 is spaced apart from the contact surface 55 and the sixth structure section 175 contacts the contact surface 55 as a fourth contact 185. In an embodiment, the first crosspiece 90 is arranged at the level of the third contact 180 and the second crosspiece 91 is arranged at the level of the fourth contact 185 in the longitudinal direction. The third contact 180 is arranged in the z-direction opposite the first contact 125 and the fourth contact 185 is arranged in the z-direction opposite the second contact 130. As a result, a tilting of the engagement section 50 in the receptacle 45 is prevented and a uniform contacting of the engagement section 50 in the receptacle 45 is ensured. The third contact 180 and the fourth contact 185 are arranged in a common second contact plane 190, the second contact plane 190 is an xy-plane and is parallel to the plane 95 and the first contact plane 120.

If the engagement section 50 of the mating contact element 20 is inserted into the receptacle 45, the engagement section 50 presses the first embossed structure 100 and the second embossed structure 160 apart in the z-direction and clamps the first box section 60 and the third box section 135. As a result of this bracing, the first box section 60 and the third box section 135 provide a bracing force Fs shown in FIG. 4. The bracing force Fs is transferred by the rigidly configured second and fourth box sections 65, 140 to the first structure section 105, the third structure section 115, the fourth structure section 165 and the sixth structure section 175 so that the first structure section 105, the third structure section 115, the fourth structure section 165 and the sixth structure section 175 are pressed onto the contact surface 55 of the engagement section 50 and thus a reliable mechanical and electrical contact 125, 130, 180, 185 is ensured between the contact box 30 and the engagement section 50. As a result, additional spring elements inside the contact element 15 for contacting the mating contact element 20 are unnecessary.

The contact element 15 can be simply configured without the spring elements and can be manufactured inexpensively. In an embodiment, the grid structure 69, 145 has expanded metal so that the contact element 15 is particularly light. Furthermore, the grid structure 69, 145 thereby has a particularly high strength.

The bracing force Fs can be simply set by the geometric configuration of the recess contour 80, 85. Thus, for example, a diamond-shaped configuration of the recess contour 80, 85 is particularly suitable for a particularly stiff configuration of the grid structure 69, 145 so that the bracing force Fs is particularly high.

Figure 5:
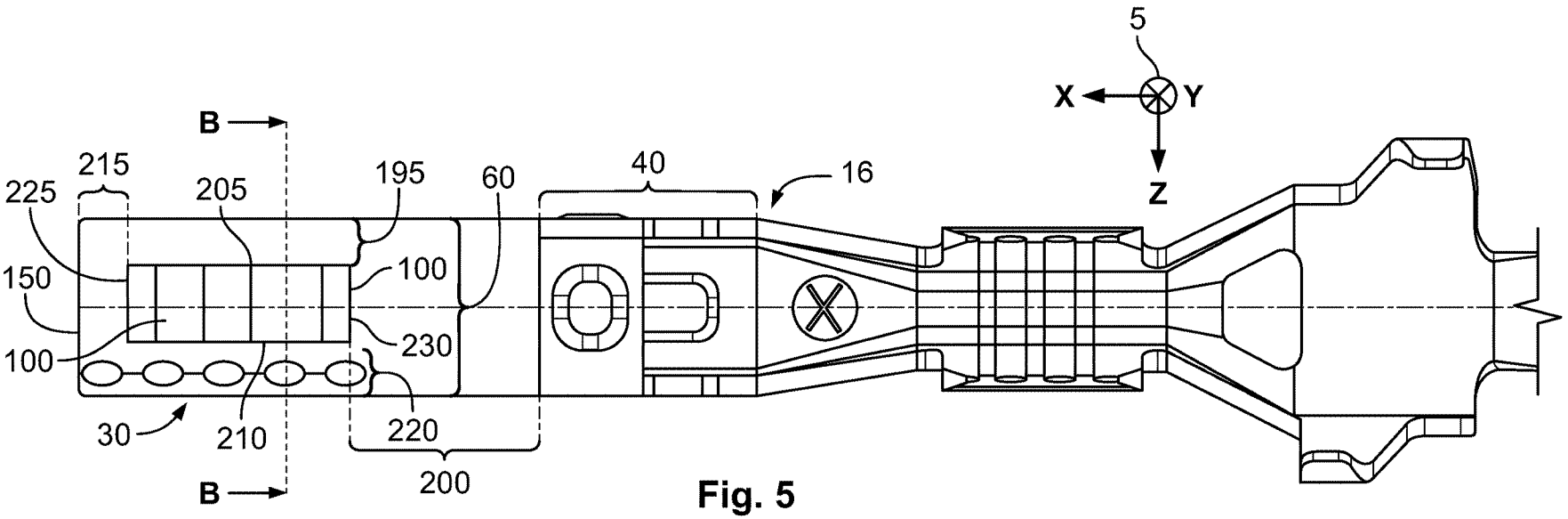
FIG. 5 is a top view of a contact element according to another embodiment.
Figure 6:
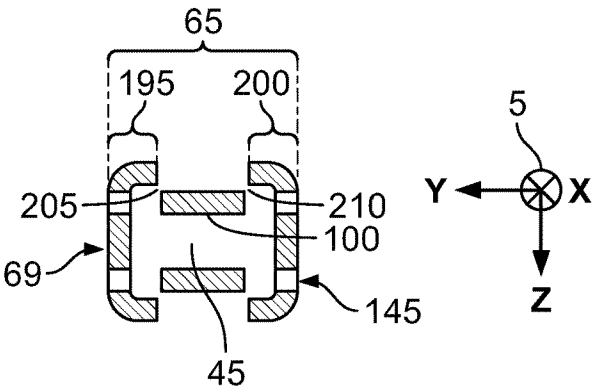
FIG. 6 is a sectional front view of the contact element, taken along line B-B of FIG. 5.

A contact element 16 according to another embodiment is shown in FIGS. 5 and 6. The contact element 16 is similar to the contact element 15 described above with reference to FIGS. 1-4 and only the differences from the contact element 15 will be described in detail herein.

In the contact element 16, as shown in FIGS. 5 and 6, the second box section 65 includes a first region 195 and a second region 200. The first embossed structure 100 is arranged between the first region 195 and the second region 200 in the y-direction. The first region 195 and the second region 200 are configured in a plate-like manner and extend in an xy-plane. A first gap 205 is arranged between the first region 195 and the first embossed structure 100, and a second gap 210 is arranged between the first embossed structure 100 and the second region 200. The first gap 205 extends parallel to the second gap 210 in the longitudinal direction.

The first box section 60, as shown in FIG. 5, includes a third region 215 and a fourth region 220. The third region 215 adjoins the receptacle opening 150 and is arranged in the longitudinal direction between a first end 225 of the first embossed structure 100 and the receptacle opening 150. The fourth region 220 is arranged in the longitudinal direction between a second end 230 of the first embossed structure 100 and the connection section 40. The first embossed structure 100 is connected to the third region 215 with the first end 225 of the first embossed structure 100, and the first embossed structure 100 is connected to the fourth region 220 with the second end 230 of the first embossed structure 100. As a result, deflection of the first embossed structure 100 can be ensured in the z-direction when the engagement section 50 is inserted into the receptacle 45 and the contact box 30 can generally be configured to be softer, and deflect more easily, than the configuration shown in FIGS. 1-4.

As a result of the gaps 205, 210, the first embossed structure 100 can be arranged over wide regions in the longitudinal direction below the first and second regions 195, 200 so that the receptacle 45 is particularly narrow in the vertical direction, as shown in FIG. 6. Furthermore, the first grid structure 69, 145 is, by way of example, configured with a finer mesh than in the embodiment of FIGS. 1-4. As a result, the first grid structure 69, 145 is also configured to be softer than in the embodiment of FIGS. 1-4 so that the mating contact element 20 can be inserted into the receptacle 45 with a particularly low insertion force.

Figure 7:
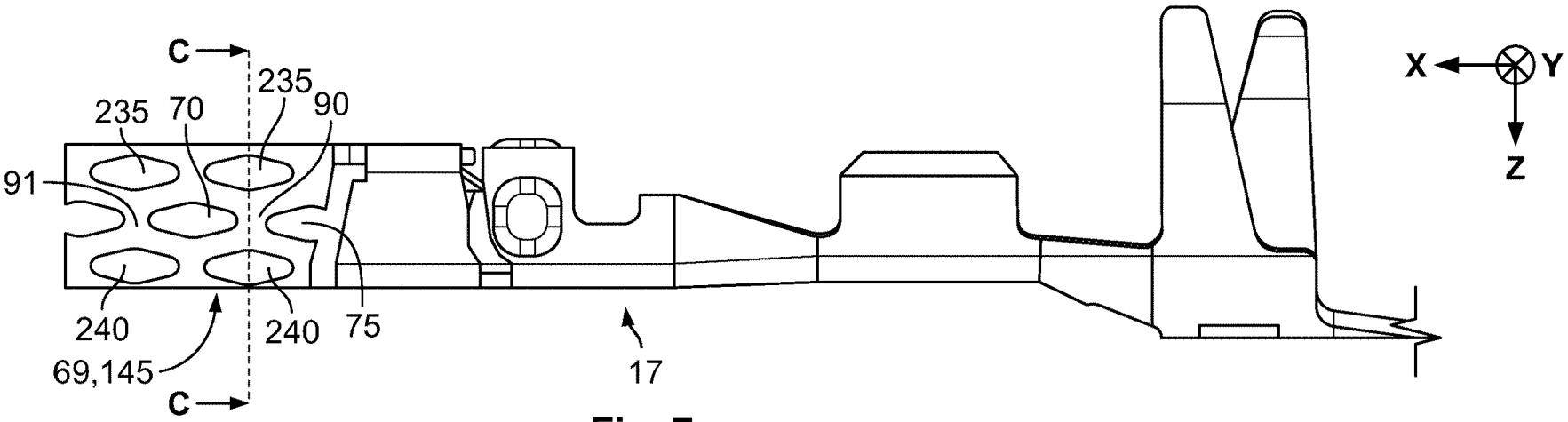
FIG. 7 is a side view of a contact element according to another embodiment.
Figure 8:
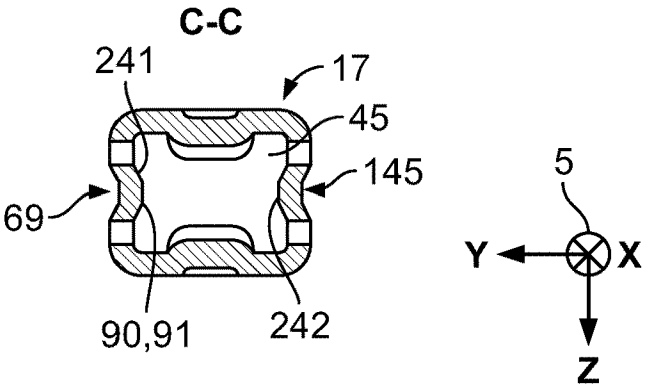
FIG. 8 is a sectional front view of the contact element, taken along line C-C of FIG. 7.

A contact element 17 according to another embodiment is shown in FIGS. 7 and 8. The contact element 17 is similar to the contact element 15 described above with reference to FIGS. 1-4 and only the differences from the contact element 15 will be described in detail herein.

In the contact element 17, the first grid structure 69, 145 has a finer mesh than in the embodiment of FIGS. 1-4. In addition, the first grid structure 69, 145 includes a plurality of third recesses 235 and a plurality of fourth recesses 240, the fourth recesses 240 being arranged below the third recesses 235 in the z-direction. The crosspiece 90, 91 extends in each case in the z-direction between one of the third recesses 235 and one of the fourth recesses 240. The third recess 235 and the fourth recess 240 are arranged offset from the first recess 70 and the second recesses 75 in the longitudinal direction.

The third and fourth recesses 235, 240 are configured identically to the first recess 70. Furthermore, the recess 70, 75, 235, 240 of the second grid structure 145 is arranged so as to overlap the respective recess 70, 75, 235, 240 of the first grid structure 69 in the longitudinal direction. In this case, overlapping in the longitudinal direction is intended to mean that, in the case of two components, for example the recess 70, 75, 235, 240 of the respective first grid structure 69, 145, projecting into a common yz-plane, said components are aligned with one another.

In addition to the first grid structure 69, the first box section 60 includes a first fold 241 as shown in FIG. 8. In addition to the second grid structure 145, the third box section 135 includes a second fold 242. In another embodiment, in the first box section 60 and/or the third box section 135, the first grid structure 69, 145 is dispensed with and the first and/or the third box section 60, 135 exclusively has the fold 241, 242.

The fold 241, 242 is, as shown in FIG. 8, configured in that the crosspiece 90, 91 has a curvature with a concave configuration with respect to the receptacle 45. When the engagement section 50 is inserted into the receptacle 45, the curvature of the crosspiece 90, 91 is reduced and the fold 241, 242 lengthens in the z-direction. As a result, the receptacle 45 can widen particularly broadly in the z-direction and the contact box 30 can be configured in a soft and elastic manner in the vertical direction. In another embodiment, the crosspiece 90, 91 can also have a convex configuration with respect to the receptacle 45.

Figure 9:
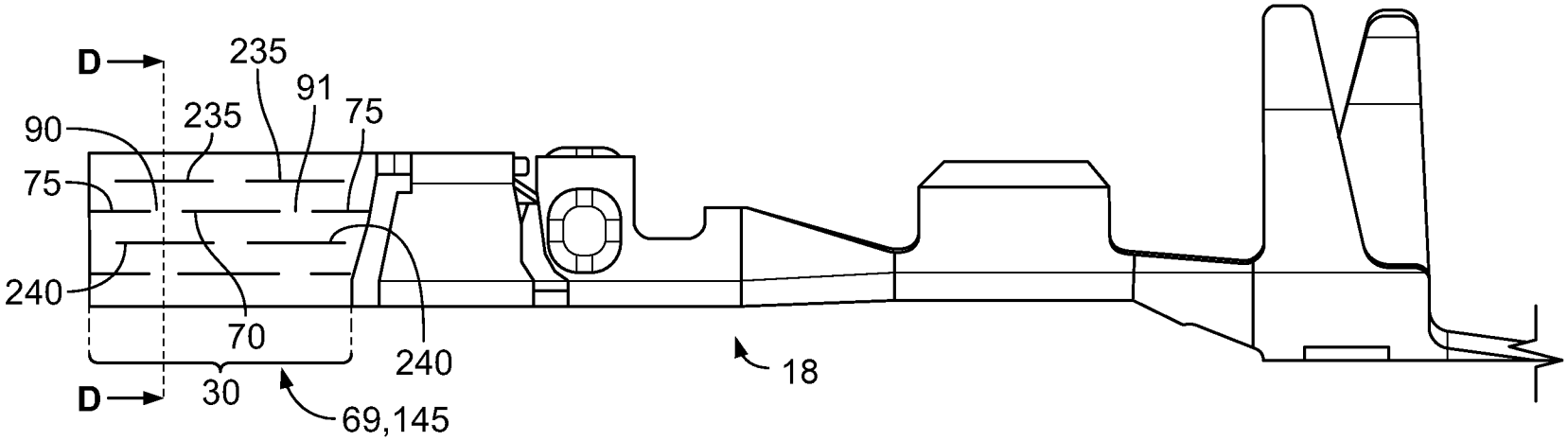
FIG. 9 is a side view of a contact element according to another embodiment.
Figure 10:
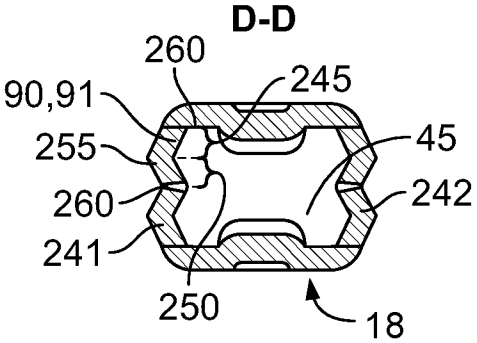
FIG. 10 is a sectional front view of the contact element, taken along line D-D of FIG. 9.

A contact element 18 according to another embodiment is shown in FIGS. 9 and 10. The contact element 18 is similar to the contact element 17 described above with reference to FIGS. 8 and 9 and only the differences from the contact element 17 will be described in detail herein. The first grid structure 69, 145 of the contact element 18 is configured with a particularly fine mesh, wherein the recess 70, 75, 235, 240 is configured in the form of a gap as shown in FIG. 9. As a result, a soft contact box 30 can be provided, particularly in the z-direction.

The fold 241, 242 of the contact element 18, as shown in FIG. 10, is configured in that the crosspiece 90, 91 includes a first crosspiece section 245 and at least a second crosspiece section 250. The first crosspiece section 245 is connected with a fixed end 255 to the second crosspiece section 250. The crosspiece sections 245, 250 extend from the fixed end 255 towards a free end 260 in the direction of the receptacle 45. In this case, the first crosspiece section 245 is arranged in an inclined manner with respect to the second crosspiece section 250, and in an embodiment, is arranged at an obtuse angle. The first grid structure 69, 145 shown in FIGS. 9 and 10 can be formed by stamping and bending with each crosspiece section 245, 250 being configured by a die.

In the embodiment shown in FIG. 10, the first crosspiece section 245 and the second crosspiece section 250 are, by way of example, configured in a plate-like manner. The first crosspiece section 245 and the second crosspiece section 250 can also each be configured to be curved, and may have a concave or convex curvature. When the engagement section 50 is inserted into the receptacle 45, the crosspiece 90, 91 is widened, and an inclination of the first crosspiece section 245 with respect to the second crosspiece section 250 is reduced. The crosspiece 90, 91 is in this case braced and then provides the clamping force Fs when the engagement section 50 is inserted into the receptacle 45.

Figure 11:
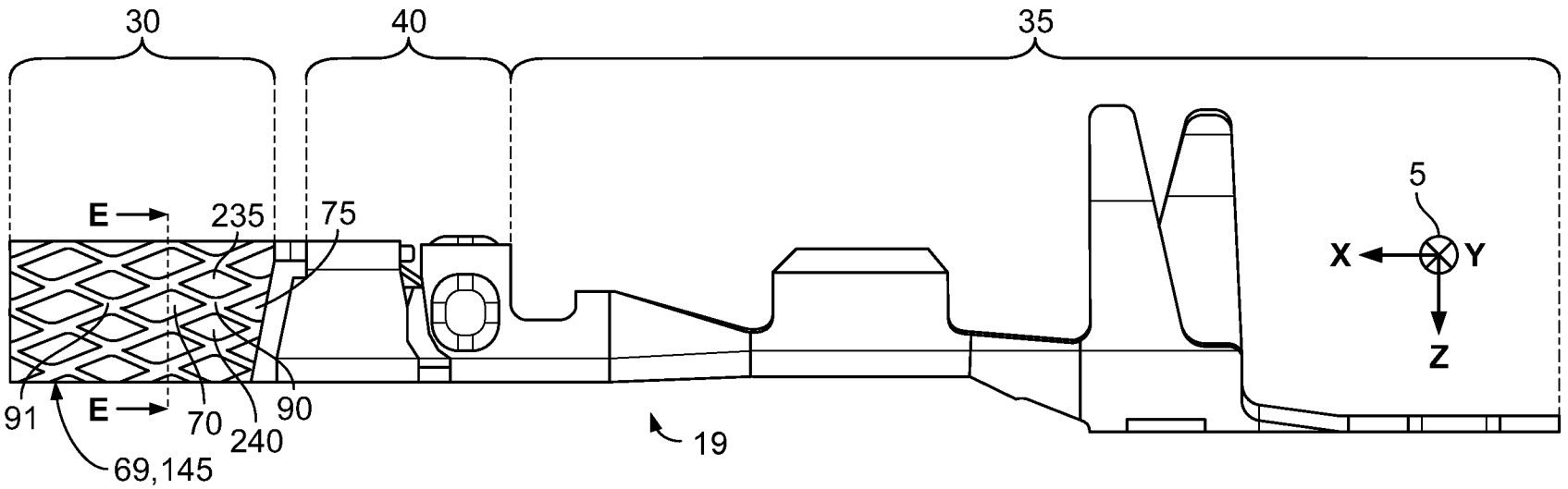
FIG. 11 is a side view of a contact element according to another embodiment.
Figure 12:
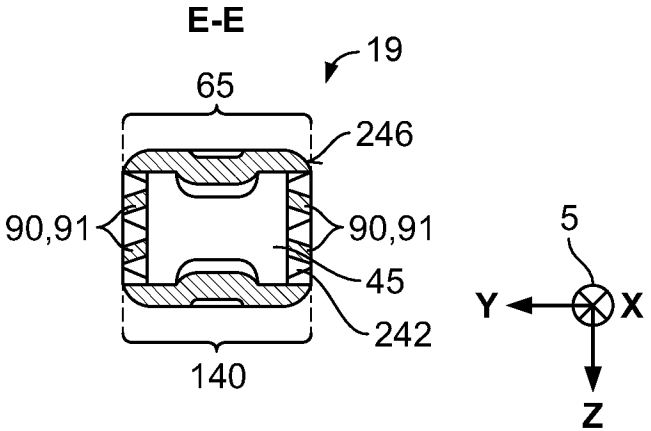
FIG. 12 is a sectional front view of the contact element, taken along line E-E of FIG. 11.

A contact element 19 according to another embodiment shown in FIGS. 11 and 12. The contact element 19 is similar to the contact elements 15-18 described above with reference to FIGS. 1-10 and only the differences from the contact elements 15-18 will be described in detail herein. The first grid structure 69, 145 of the contact element 19 has a particularly thinly configured crosspiece 90, 91 and a particularly high number of recesses 70, 75, 235, 240. In this case, a plane of a section (in a longitudinal section) of the crosspiece 90, 91 is smaller than a surface of the recess 70, 75, 235, 240. As a result, the first grid structure 69, 145 is particularly elastic in the z-direction. In an embodiment, the first grid structure 69, 145 is formed of an expanded metal material.

As shown in FIG. 12, in the contact element 19, the crosspiece 90, 91 is arranged obliquely in an inclined manner with respect to the second and fourth box sections 65, 140. In this case, the crosspiece 90, 91 is aligned towards the second box section 65, by way of example, from a contact box exterior 246 towards the receptacle 45. In another embodiment, the crosspiece 90, 91 can also be aligned towards the fourth box section 140 from the contact box exterior 245 towards the receptacle 45.

In other embodiments, features of the different configurations of the contact element 15-19 can be combined with each other or individual features can also be omitted.

In another embodiment, the contact element 15-19 may have an additional contact box arranged circumferentially on the contact box 30 shown in FIGS. 1-12 and circumferentially engaging the contact box 30. In this case, the additional contact box is configured similarly to the contact box 30 which has the first grid structure 69, 145 and which is shown in FIGS. 1-12.

The contact element 15-19 is particularly light and has a low material consumption during manufacture since it is possible to dispense with an internal spring inside the contact box 30. Further, the first and/or the third box section 60, 135 can optimally be adapted to a mechanical stress distribution inside the contact box 30 so that a stress distribution inside the contact box 30 is homogenized and a maximum stress for the required clamping force Fs inside the contact box 30 is reduced. As a result, the contact element 15 can also be produced from less spring-tempered special alloys. In the contact element 15-19, a characteristic of the first and/or third box sections 60, 135 can be simply adapted by a corresponding constructive configuration of the first grid structure 69, 145. For a stiff characteristic, the recess 70, 75, 235, 240 substantially comprises a maximum perimeter which is located in the region of a material thickness of the first box section 60 and/or of the third box section 135.

Further, as a result of the provision of the first grid structure 69, 145, the contact element 15-19 can be produced by machines which are already currently used during the manufacture of the contact element 15-19, wherein following the manufacture of the first grid structure 69, 145 the contact box 30 can be bent and welded in an overlapping arrangement, and in an embodiment, laser-welded or clinched.

What is claimed is:

1. A contact element, comprising:

a contact box extending in a longitudinal direction of the contact element and delimiting a receptacle, the contact box including a first box section, a second box section, a third box section arranged opposite the first box section, and a fourth box section arranged opposite the second box section, the second box section and the fourth box section each connect the first box section to the third box section, the first box section extends perpendicularly with respect to the second box section and the third box section extends perpendicularly with respect to the fourth box section, the first box section and the third box section each extend in a plane along the longitudinal direction and a vertical direction orthogonal to the longitudinal direction, at least one of the first box section or the third box section is a tension spring, the tension spring including a grid structure comprising a plurality of recesses configured in an elastic manner elastically deformable in the vertical direction, the second box section and the fourth box section are each configured in a rigid manner.

2. The contact element of claim 1, wherein the first box section and the third box section are tension springs.

3. The contact element of claim 1, wherein the first box section and the third box section include a grid structure.

4. The contact element of claim 3, wherein the grid structure includes a recess with a recess contour, the recess contour is at least in sections diamond-shaped and/or rectangular and/or square and/or polygonal and/or round and/or elliptical and/or circular and/or slotted.

5. The contact element of claim 1, wherein the grid structure includes a first recess, a second recess, and a crosspiece arranged between the first recess and the second recess.

6. The contact element of claim 5, wherein the first recess and the second recess have an identical configuration.

7. The contact element of claim 5, wherein the crosspiece has a planar configuration.

8. The contact element of claim 5, wherein the crosspiece has a curvature with a concave configuration with respect to the receptacle, the curvature defined about an axis of curvature extending in the longitudinal direction.

9. The contact element of claim 5, wherein the second box section includes a first embossed structure having a first structure section and a second structure section, the first structure section is arranged offset from the second structure section transversely to the longitudinal direction, a first contact for electrically contacting a mating contact element is disposed on a side of the first structure section facing the receptacle.

10. The contact element of claim 9, wherein the crosspiece is arranged in the longitudinal direction at a level of the first contact or the crosspiece is arranged offset from the first contact in the longitudinal direction.

11. The contact element of claim 10, wherein a gap is disposed between the first structure section and a region of the second box section, the gap extends in the longitudinal direction.

12. The contact element of claim 9, wherein the first embossed structure includes a third structure section connected to the second structure section and having a second contact on a side facing the receptacle, the second contact and the first contact are arranged in a contact plane.

13. The contact element of claim 12, wherein the first recess and the second recess are arranged in a plane parallel to the contact plane.

14. The contact element of claim 1, wherein the first box section and the third box section are parallel to each other and/or the second box section and the fourth box section are parallel to each other.

15. The contact element of claim 1, wherein the first box section and the third box section are symmetrical about a plane of symmetry arranged between the first box section and the third box section.

16. The contact element of claim 9, wherein the fourth box section includes a second embossed structure having a fourth structure section and a fifth structure section, the fifth structure section is arranged offset from the fourth structure section transversely to the longitudinal direction, a third contact is disposed on a side of the fourth structure section facing the receptacle.

17. The contact element of claim 1, wherein the tension spring includes a fold extending in the longitudinal direction.

18. The contact element of claim 1, wherein neither the first box section nor the third box section has a cantilevered spring element.

19. A contact element, comprising:

a contact box extending in a longitudinal direction of the contact element and delimiting a receptacle, the contact box including a first box section, a second box section, a third box section arranged opposite the first box section, and a fourth box section arranged opposite the second box section, the second box section and the fourth box section each connect the first box section to the third box section, the first box section and the third box section are each configured in an elastic manner elastically deformable in a vertical direction orthogonal to the longitudinal direction and the second box section and the fourth box section are each configured in a rigid manner, the second box section and the fourth box section are each inclined with respect to the first box section, the first box section and/or the third box section includes a grid structure and/or a fold, the grid structure includes a recess with a recess contour, the recess contour is at least in sections diamond-shaped and/or rectangular and/or square and/or polygonal and/or round and/or elliptical and/or circular and/or slotted, the grid structure includes a first recess, a second recess, and a crosspiece arranged between the first recess and the second recess, the crosspiece includes a first crosspiece section and a second crosspiece section arranged adjacent to the first crosspiece section, the first crosspiece section is arranged in an inclined manner with respect to the second crosspiece section.

20. The contact element of claim 19, wherein the first crosspiece section and the second crosspiece section are each configured in a plate-like manner, a fixed end of the first crosspiece section is connected to the second crosspiece section, the first crosspiece section extends inwardly from the fixed end towards a free end of the first crosspiece section in a direction of the receptacle.

21. A contact element, comprising:

a contact box extending in a longitudinal direction of the contact element and delimiting a receptacle, the contact box including a first box section, a second box section, a third box section arranged opposite the first box section, and a fourth box section arranged opposite the second box section, the second box section and the fourth box section each connect the first box section to the third box section, the first box section and the third box section are each configured in an elastic manner elastically deformable in a vertical direction orthogonal to the longitudinal direction and the second box section and the fourth box section are each configured in a rigid manner, the second box section and the fourth box section are each inclined with respect to the first box section, the first box section and/or the third box section includes a grid structure and/or a fold, the grid structure includes a recess with a recess contour, the recess contour is at least in sections diamond-shaped and/or rectangular and/or square and/or polygonal and/or round and/or elliptical and/or circular and/or slotted, the grid structure includes a first recess, a second recess, and a crosspiece arranged between the first recess and the second recess, the second box section includes a first embossed structure having a first structure section and a second structure section, the first structure section is arranged offset from the second structure section transversely to the longitudinal direction, a first contact for electrically contacting a mating contact element is disposed on a side of the first structure section facing the receptacle, the fourth box section includes a second embossed structure having a fourth structure section and a fifth structure section, the fifth structure section is arranged offset from the fourth structure section transversely to the longitudinal direction, a third contact is disposed on a side of the fourth structure section facing the receptacle.

* * * * *